US006483925B1

(12) United States Patent
Shen et al.

(10) Patent No.: US 6,483,925 B1
(45) Date of Patent: Nov. 19, 2002

(54) HEADPHONE HAVING SEVERAL SPEAKERS

(76) Inventors: Yao-Sheng Shen, 4F., No. 15, Lane 125, Shetru St., Taipei (TW); Ken-Pei Hu, No. 22, Lane 129, Yun Hsiang Shan Chuang, Sheng Kao Village, Shen Keng Shiang, Taipei Hsien (TW)

( * ) Notice: Subject to any disclaimer, the term of this patent is extended or adjusted under 35 U.S.C. 154(b) by 0 days.

(21) Appl. No.: 09/894,131

(22) Filed: Jun. 29, 2001

(30) Foreign Application Priority Data

May 29, 2001 (TW) ..... 90112961 A

(51) Int. Cl.[7] ..... H04R 25/00

(52) U.S. Cl. ..... 381/370; 381/374; 381/377; 381/379

(58) Field of Search ..... 381/74, 77, 309, 381/26, 370, 376, 381, 384, FOR 149, FOR 150, 382; 379/430; 455/568

(56) References Cited

U.S. PATENT DOCUMENTS

| | | | | | |
|---|---|---|---|---|---|
| 3,900,707 | A | * | 8/1975 | Hanson | 381/370 |
| 4,110,583 | A | * | 8/1978 | Lepper | 381/382 |
| 4,173,715 | A | * | 11/1979 | Gosman | 381/382 |
| 5,740,254 | A | * | 4/1998 | Thompson et al. | 381/309 |
| 5,812,683 | A | * | 9/1998 | Parker et al. | 381/370 |

* cited by examiner

*Primary Examiner*—Huyen Le
(74) *Attorney, Agent, or Firm*—Bacon & Thomas, PLLC

(57) ABSTRACT

A headphone. The headphone includes at least three speakers. Two of the speakers are held to the ears and the other speaker is in contact with parts of the head other than the ears so that sound from speakers is audible by the ears. A signal line having a conductor and a power line are both coupled to each speaker so that external signals are sent to the speakers through the conductor and an external electrical power of source is applied to the speakers through the power line respectively.

9 Claims, 5 Drawing Sheets

HEADPHONE HAVING SEVERAL SPEAKERS

FIELD OF THE INVENTION

The present invention relates to headphone and more particularly to an improved headphone having several speakers.

BACKGROUND OF THE INVENTION

Recently, electronics technology has known a rapid and a spectacular development leading to an availability of more inexpensive electronic products to consumers. In the example of audio products, a good quality is always the target of manufacturers. A Dolby effect disclosed by Dolby Company is a most frequently used audio processing format. Further, Dolby effect has evolved from mono sound to Dolby Stereo, Dolby Surround, Dolby Surround Pro Logic, and Dolby Digital. In response, the number of speakers of a stereo is increased in addition to requirements about locations of speakers and others. As a result, an optimum sound may be realized. In the case of Dolby Surround technique a front left, a front right, a rear left, and a rear right speakers are disposed around a stereo so as to form a sound surround effect. As to the coded playing of sound, signals of surround portion of sound are coded into left and right sound signals. Further, a decoding circuit is enabled to fetch such signals of surround portion of sound as stereo is playing. Hence, the front left, front right, rear left, and rear right speakers can output sound respectively. At the same time, complimentary portions of left and right sound channels may be processed by a predetermined circuit so as to enhance the surround effect and the orientation of sound. Moreover as to Dolby Surround Pro Logic technique, a central speaker is added into a stereo configured to play in a Dolby Surround environment wherein the coded playing of sound may increase the coding of the central portion of sound. As to existing AV devices such as VCRs, TVs, LDs, DVD players, etc. Dolby Digital technique is employed to record sound into six channels. Further, a destructive compression is performed to store sound signals in the channels in a digital manner so as to increase sound articulation. And in turn a better orientation and moving effect of sound may be obtained. Furthermore, such technique increases the surround range. In the example of playing a movie, each speaker installed in various locations of a theater may make a sound respectively. As a result, a stereo effect is brought onto viewers. Moreover, in the case of digital AV device, a Digital Theater System (DTS) is employed which is advantageous over Dolby Digital with respect to sound regeneration. Hence, such DTSs have been widely employed in Digital Versatile Discs (DVDs).

However, a sufficient space is required for disposing speakers in one of Dolby Surround, Dolby Surround Pro Logic, Dolby Digital, and DTS environments so as to obtain an optimum surround sound. Otherwise, the desired effect may be compromised. Further, powers of speakers must be suitably configured for obtaining an optimum sound effect. Otherwise in the case of excessive large powers of speakers, nearby people may be annoyed. In another case of excessive small powers of speakers, people may not hear the surround sound clearly. This may be best illustrated when a person alone listens to music or watches a movie wherein powers of speakers are adjusted to a minimum. As a result, a desired sound effect is compromised, thus frustrating the person who alone listens to music or watches a movie.

Moreover, signal lines between speakers and the stereo/AV device are required for signal communication. It may be messy. Hence, signal lines may be broken accidentally by person walking in the environment. In the case of connecting a computer to several speakers having Dolby Digital effect, signal lines are typically extended from computer ports to ground vertically prior to coupling to speakers. The signal lines are subject to break in the narrow space accordingly. Thus improvement exists.

SUMMARY OF THE INVENTION

It is therefore an object of the present invention to provide a headphone comprising at least three speakers wherein two of the speakers are held to the ears and the other speaker is in contact with parts of the head other than the ears so that sound from speakers is audible by the ears; a signal line having a conductor and a power line both coupled to each speaker so that external signals are sent to the speakers through the conductor and an external electrical power of source is applied to the speakers through the power line respectively; and at least one signal receiver element formed on a headband being connectable to a sound reproducing device for receiving signals. By utilizing this, a surround sound effect is obtained.

The above and other objects, features and advantages of the present invention will become apparent from the following detailed description taken with the accompanying drawings.

DETAILED DESCRIPTION OF THE PREFERRED EMBODIMENTS

Figure 1:
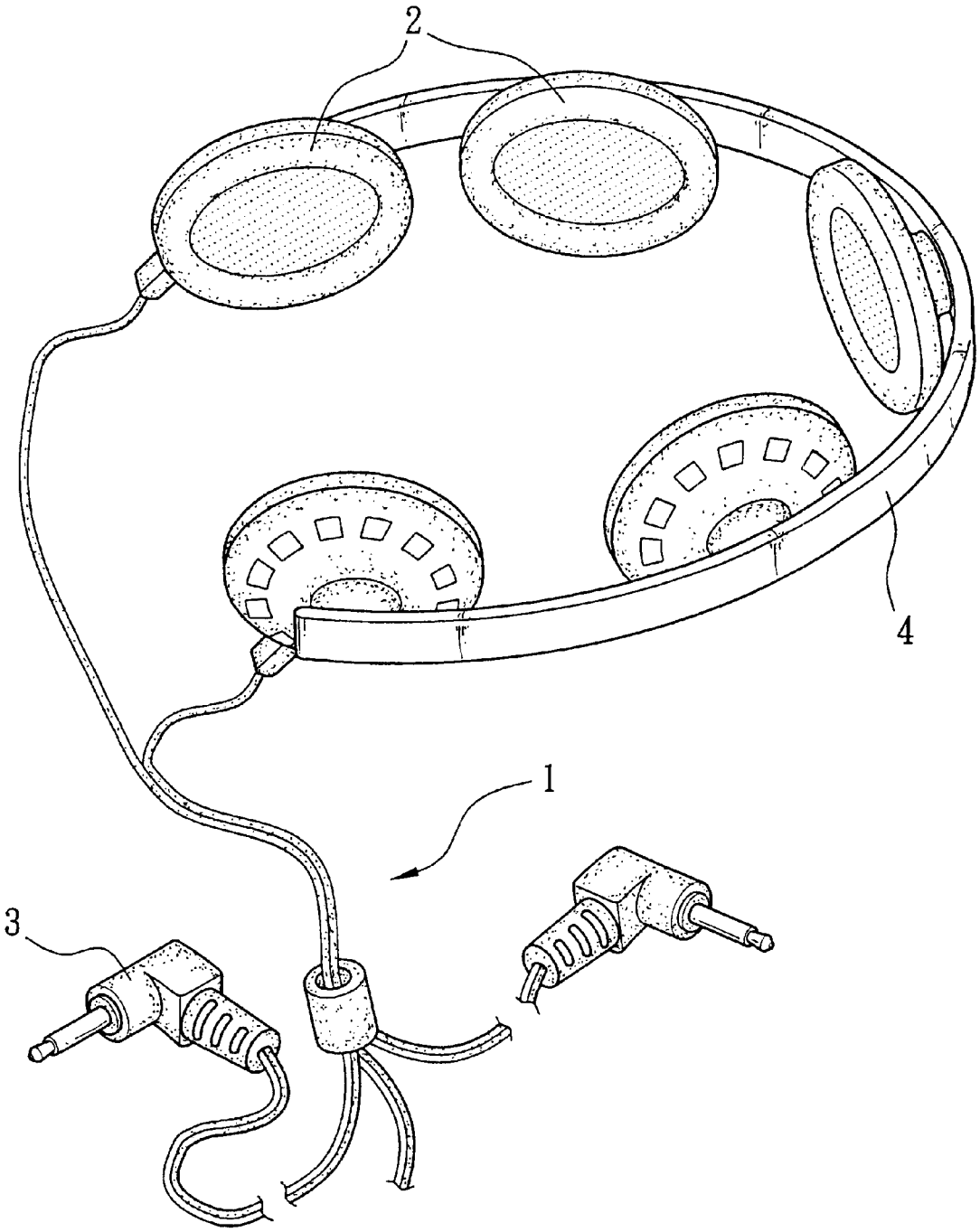
FIG. 1 is a perspective view of a first preferred embodiment of headphone according to the invention.
Figure 2:
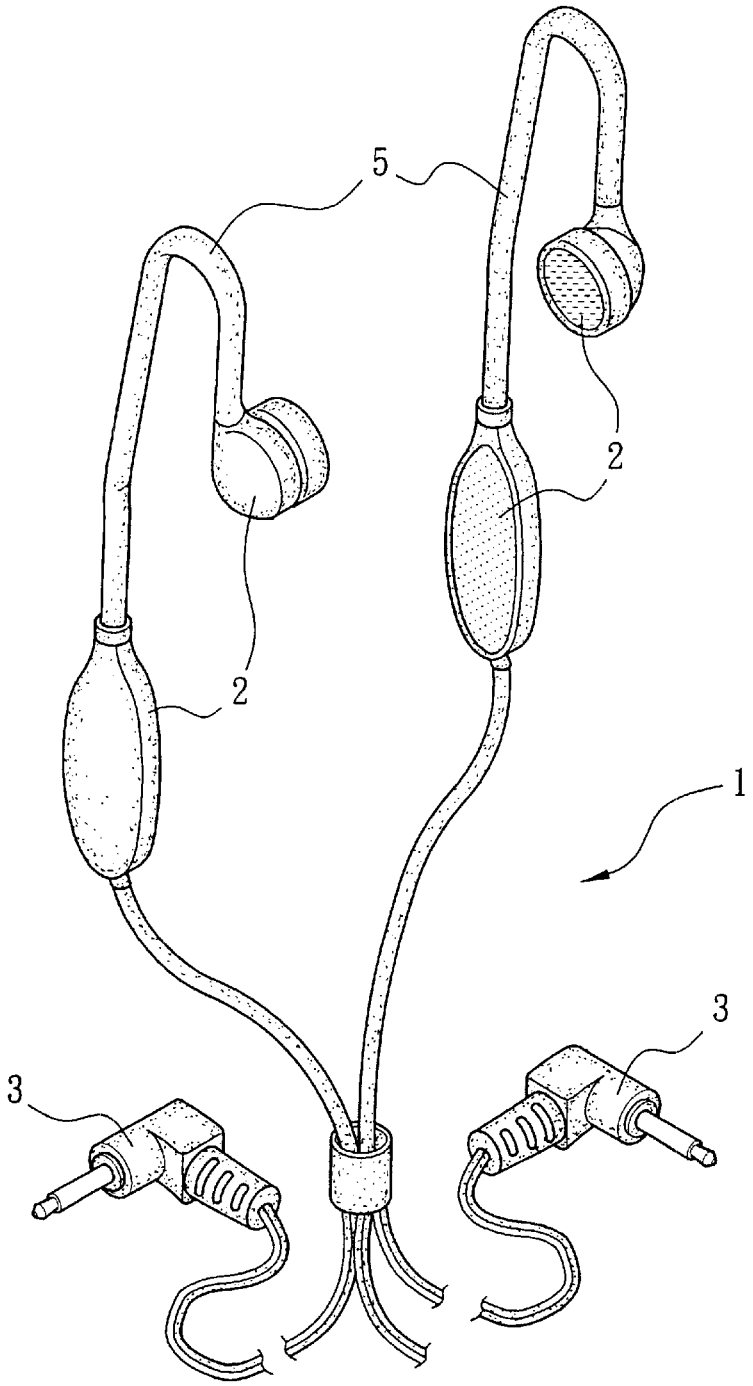
FIG. 2 is a perspective view of a second preferred embodiment of headphone according to the invention.
Figure 3:
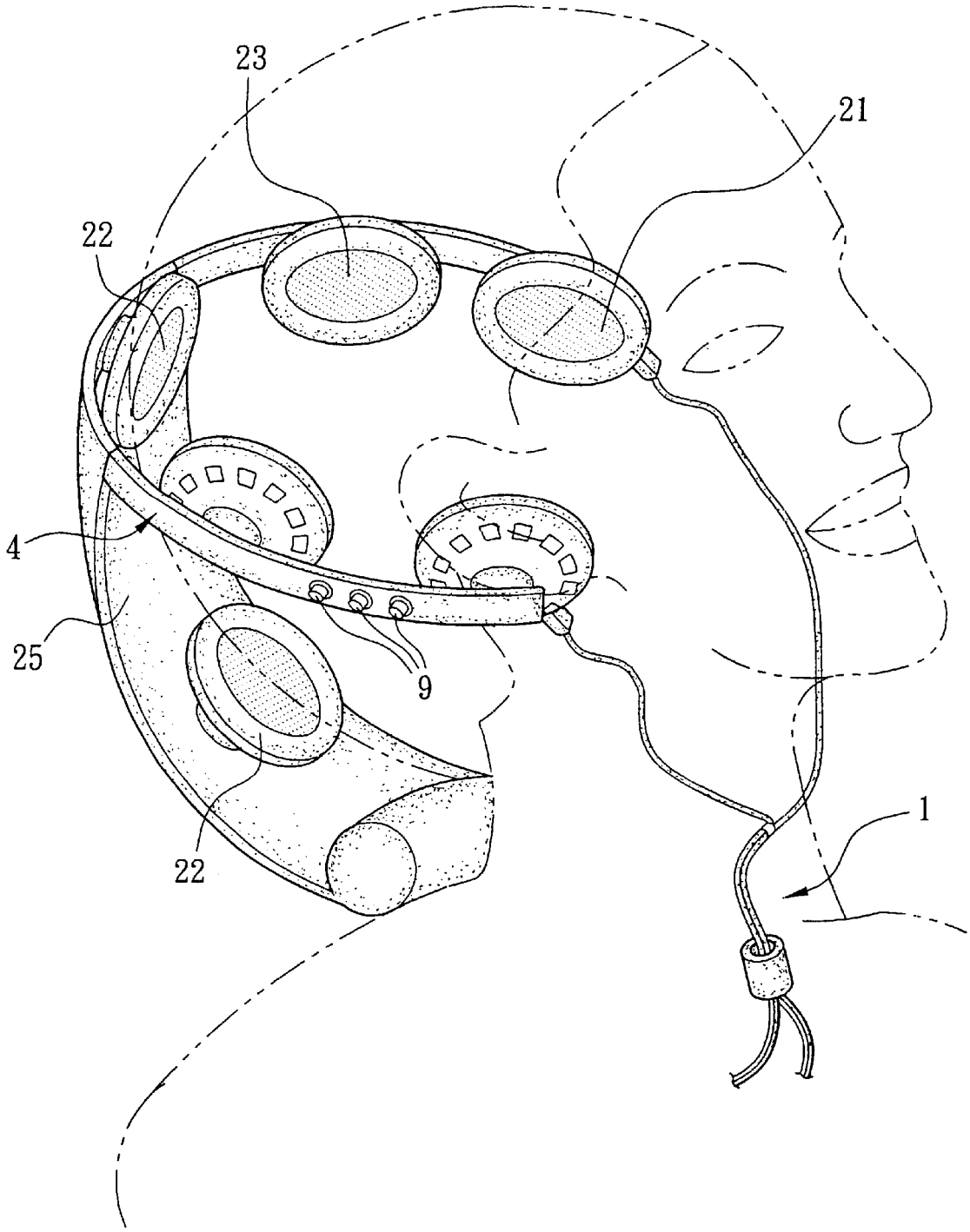
FIG. 3 is an environmental view of the headphone according to the invention being held to the ears.

Referring to FIGS. 1 to 3, there is shown a headphone in accordance with the invention. The headphone comprises a signal line 1 and at least three speakers 2 (five are shown in FIG. 1) wherein two speakers 2 are held to the ears and other speakers 2 are in contact with other parts of the head (e.g., the neck and the rear side of the head). Hence, sound from speakers 2 may be heard by the ears. A conductor and a power line are provided in signal line 1 both coupled to each speaker 2. Hence, when headphone is held to the ears signals from a sound reproducing device (i:e., stereo) may be sent to speakers 2 through the conductor and electrical power may be applied to speakers 2 through the power line respectively.

In the invention, at least one plug 3 (two are shown) is formed on the other end of signal line 1 away from speakers. Plug 3 as signal receiver element is connectable to a sound reproducing device for receiving signals. It is understood that the number and specifications of ports of sound reproducing device may be varied depending on output signals having various sound processing formats. Hence in the invention, the number and specifications of plugs 3 of sound reproducing device may be varied depending on the number of output ports and specifications required by the sound processing formats. Currently, there are adapters available for adapting to various outputs having sound processing formats wherein one end of adapter is connectable to output end of plug 3 of headphone and the other end is connectable to output port of sound reproducing device. As such, headphones have sound processing formats different from that of sound reproducing devices may emulate the sound processing format of headphone through the adapter. As a result, speakers of headphone may make a sound.

Figure 5:
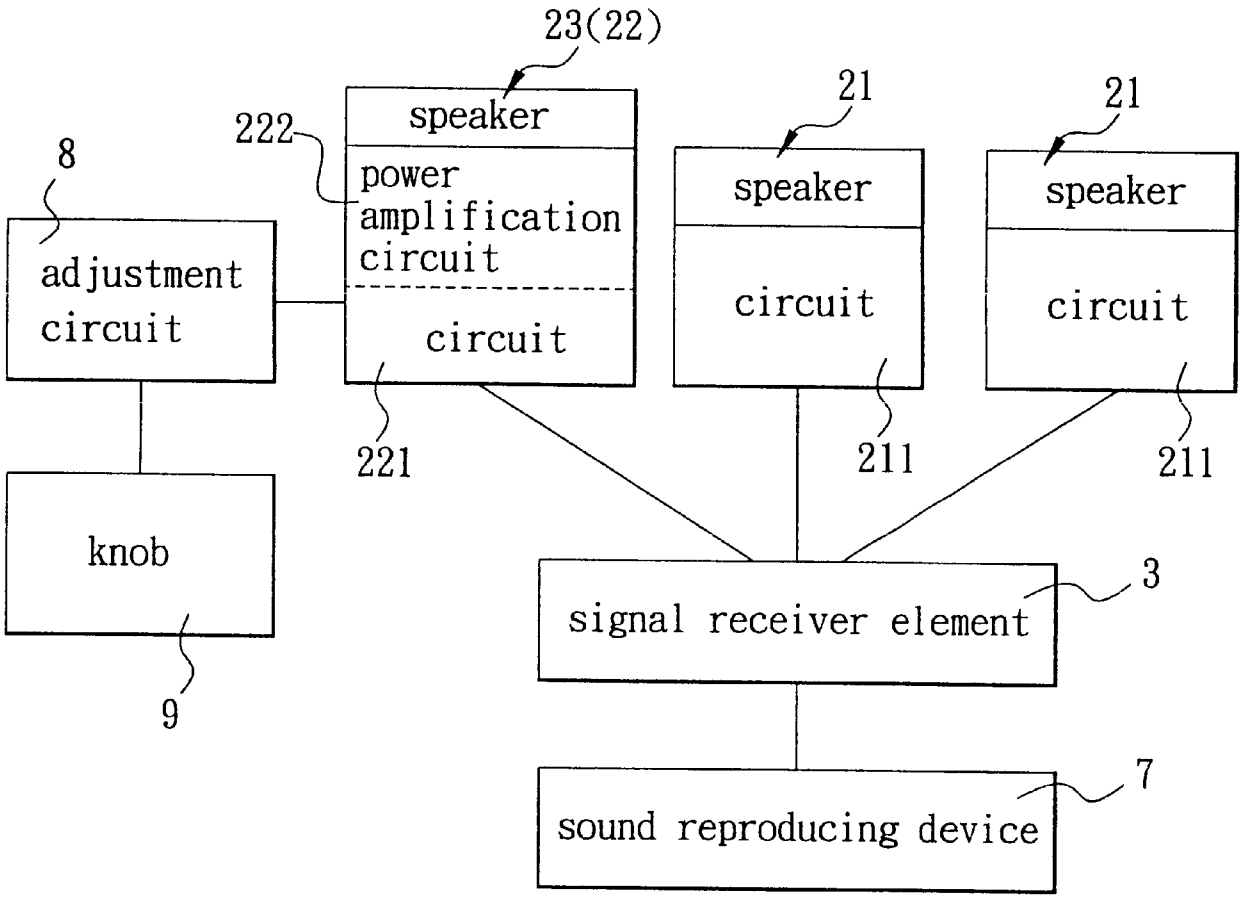
FIG. 5 is a block diagram of the present invention.

In the invention, plug is capable of receiving radio signals transmitted from a transmitter of a sound reproducing device 7, shown in FIG. 5, (i.e., a radio signal receiver). The circuit of plug may then process the received signals prior to sending it to speakers for output.

Figure 4:
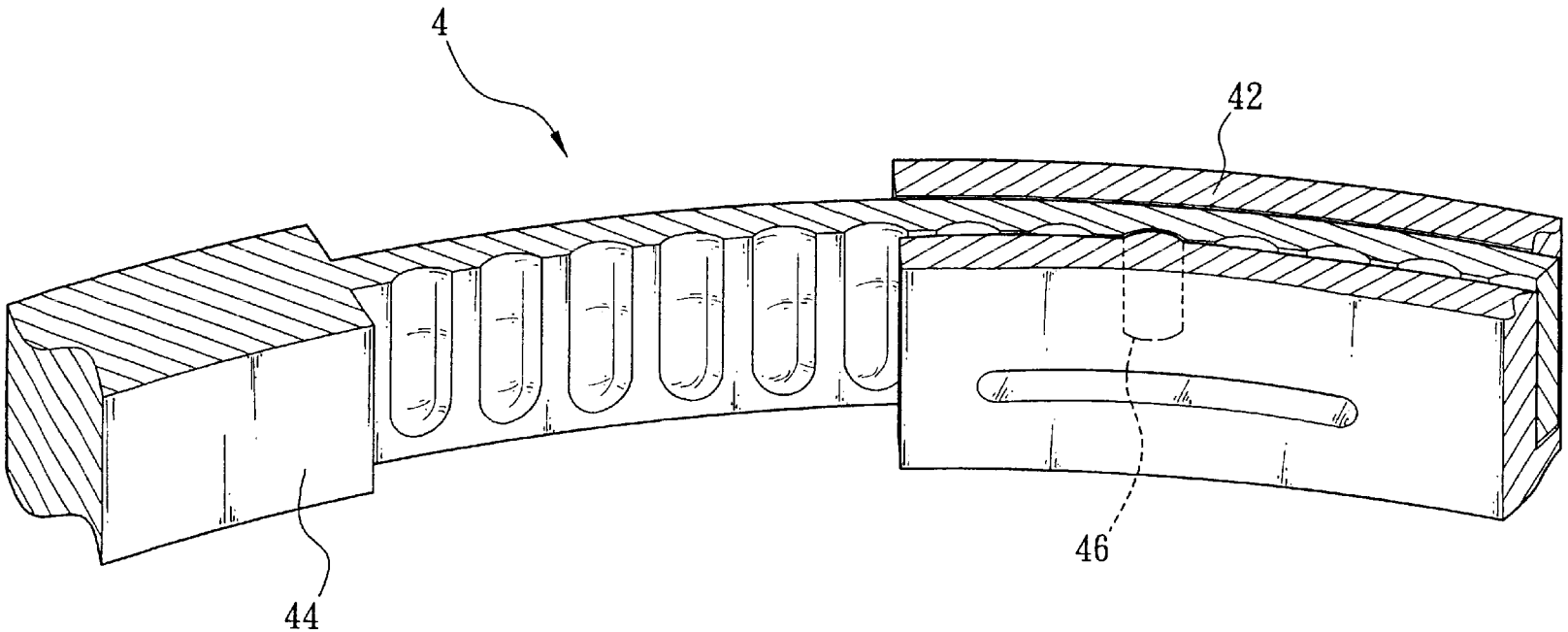
FIG. 4 is a partially cut-out view of a headband of the present invention.

In a first embodiment of the invention (FIG. 1), speakers 2 are coupled to an inner side of first headband 4 wherein two speakers 2 at the ends of first headband 4 are held to the ears and other remaining speakers 2 are in contact with the rear side of the head. In the embodiment (also shown in FIG. 4), the first headband 4 is flexible and comprises a connection member 42 in one side thereof, an adjustment member 44 on the other side thereof slidable in the connection member, and a fastening member 46 so that users may adjust the length of the first headband 4 for adapting the heads of users by sliding the adjustment member 44 in the connection member prior to fastening by the fastening member 46. In the embodiment, as shown in FIG. 3, there is a central brace 25. The brace 25 is in contact with the head or the neck of a user while the user wears the headphone. Hence, the first headband having a plurality of coupled speakers will not easily detach from a user. In addition, a speaker (e.g., woofer) may be provided in the brace 25 for bringing a vibration effect while the headphone is activated.

In a second embodiment of the invention (FIG. 2), a plurality of spaced apart speakers 2 are coupled to a second headband 5. At least one end of the speaker 2 is held to the ear and other remaining speakers 2 are in contact with other parts of the body. As shown, the second headband 5 is flexible arcuate member. Hence, the speakers 2 not held to the ears may be suitably disposed by arranging the second headband 5. In this configuration, sound from the speakers 2 not held to the ears are indirectly transmitted to the ears, while the speakers 2 held to the ears are directly transmitted to the ears. Hence, sound from speakers 2 cannot be heard by the ears simultaneously if output powers of the speakers 2 are the same. In otherwords, sound is distorted. For solving the distortion, the output powers of the speakers 2 not held to the ears are required to adjust to a number of times larger than that of the speakers 2 held to the ears in the invention. In detail, a power amplification circuit 222 (shown in FIG. 5) is provided in each of the speakers 2 not held to the ears so that the amplification of output power thereof may be realized.

It is understood that an optimum surround effect is obtained only through cooperation of output sounds of the speakers. Accordingly in the invention, an adjustment circuit 8 (shown in FIG. 5) is provided in each speaker 2 for making a variety of sound effects (e.g., surround, speaker power, bass, etc.). The adjustment circuit 8 is coupled to circuits 221 (shown in FIG. 5) in each speaker 2 via at least one knob 9 (shown in FIG. 5) of the speaker 2 so that a user may adjust knobs 9 to send generated adjustment signals from the adjustment circuit 8. Circuits 211, 221 in speakers 2 may then process the received signal from making an optimum sound effect. As a result, an optimum surround effect is obtained from the speakers 2.

In an example shown in FIG. 3, two speakers 21 (e.g., conventional front left and front right speakers) at the ends of headband 4 are held to the ears. Also, there is a central brace 25 on the headband 4. Another speaker 22 (e.g., conventional woofer) is provided in the brace 25. Still another pair of speakers 23 (e.g., conventional rear left and rear right speakers) are provided in the brace 25 with each speaker 23 located between one speaker 21 and speaker 22. Speakers 22 and 23 are in contact with other parts of the head other than the ears. When plugs of signal line 1 are coupled to a sound reproducing device 7, a surround effect around the head is obtained by the configuration of speakers 21, 22, and 23 of headphone.

While the invention has been described by means of specific embodiments, numerous modifications and variations could be made thereto by those skilled in the art without departing from the scope and spirit of the invention set forth in the claims.

What is claimed is:

1. A headphone comprising:

at least three first speakers wherein two of said first speakers are adapted to be held against ears of a user and the remaining first speaker is adapted to be in contact with parts of a user's head other than the ears so that sound from said first speakers is audible by the ears;

a signal line having a conductor and a power line both coupled to each one of said first speakers so that external signals are sent to said first speakers through said conductor and an external electrical power of source is applied to said first speakers through said power line respectively;

at least one signal receiver element formed on a flexible member being connectable to a sound reproducing device for receiving signals; and a central brace connected to said flexible member and adapted to contact a user's head or neck.

2. The headphone of claim 1, wherein said signal receiver element is a radio signal receiver for receiving radio signals transmitted from a transmitter of said sound reproducing device.

3. The headphone of claim 1, wherein said flexible member comprises a support means wherein two of said first speakers disposed at both ends thereof and the other first speaker disposed therebetween.

4. The headphone of claim 1, wherein said flexible member is a headband with said speakers spaced apart therebetween.

5. The headphone of claim 1, wherein output powers of said speaker not held to the ears is adjusted to a number of times larger than that of said speakers held to the ears.

6. The headphone of claim 1, further comprising a power amplification circuit in each speaker not held to the ears.

7. The headphone of claim 1, further comprising an adjustment circuit in each speaker and at least one knob in each speaker, and wherein each adjustment circuit is coupled to circuits in each speaker via said knob.

8. A headphone comprising:

at least three first speakers wherein two of said first speakers are adapted to be held against ears of a user and the remaining first speaker is adapted to be in contact with parts of a user's head other than the ears so that sound from said first speakers is audible by the ears;

a signal line having a conductor and a power line both coupled to each one of said first speakers so that external signals are sent to said first speakers through said conductor and an external electrical power of source is applied to said first speakers through said power line respectively;

at least one signal receiver element formed on a flexible member being connectable to a sound reproducing device for receiving signals;

said flexible member is a support means with two of said first speakers are disposed at both ends thereof and the other first speaker disposed therebetween; and said support means comprises a connection member at one side thereof, an adjustment member on another side thereof and being slidable in said connection member, and a fastening member being operative to fasten said support means in response to a length adjustment of said connection member and said adjustment member.

9. The headphone of claim 8, wherein said central brace comprises a second speaker.

* * * * *